US008487540B2

(12) United States Patent
Dijkstra et al.

(10) Patent No.: US 8,487,540 B2
(45) Date of Patent: Jul. 16, 2013

(54) VARIABLE LIGHT-LEVEL PRODUCTION USING DIFFERENT DIMMING MODES FOR DIFFERENT LIGHT-OUTPUT RANGES

(75) Inventors: Jacob Dijkstra, Eindhoven (NL); Wilhelmus Ettes, Eindhoven (NL); Schelte Heeringa, Eindhoven (NL); Petrus Johannes Bremer, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 363 days.

(21) Appl. No.: 12/746,945

(22) PCT Filed: Dec. 12, 2008

(86) PCT No.: PCT/IB2008/055245

§ 371 (c)(1), (2), (4) Date: Jun. 9, 2010

(87) PCT Pub. No.: WO2009/077951

PCT Pub. Date: Jun. 25, 2009

(65) Prior Publication Data

US 2010/0270936 A1 Oct. 28, 2010

(30) Foreign Application Priority Data

Dec. 14, 2007 (EP) ..... 07123201

(51) Int. Cl.
*H05B 37/02* (2006.01)

(52) U.S. Cl.
USPC ..... 315/209 R; 315/247; 315/291; 315/219; 315/224

(58) Field of Classification Search
USPC ..... 315/247, 274, 224, 225, 209 R, 246, 315/291, 297, 307–311, 105–107, 94, 97, 315/98
See application file for complete search history.

(56) References Cited

U.S. PATENT DOCUMENTS

| | | | |
|---|---|---|---|
| 2,866,133 | A | 12/1958 | Strange et al. |
| 4,924,150 | A | 5/1990 | Nilssen |
| 5,008,865 | A | 4/1991 | Shaffer et al. |
| 5,381,077 | A | 1/1995 | McGuire |
| 5,420,481 | A | 5/1995 | McCanney |
| 6,008,583 | A | 12/1999 | Breuer et al. |
| 6,191,539 | B1 | 2/2001 | Green |
| 2003/0222593 | A1 | 12/2003 | Yamamoto |
| 2004/0004447 | A1 | 1/2004 | Trostl et al. |
| 2006/0007719 | A1 | 1/2006 | Shannon et al. |
| 2006/0125413 | A1 | 6/2006 | Chou et al. |
| 2006/0175975 | A1 | 8/2006 | Haverlag et al. |
| 2006/0214605 | A1 | 9/2006 | Fischer et al. |
| 2007/0132401 | A1 | 6/2007 | Gawrys et al. |
| 2007/0138967 | A1 | 6/2007 | Chen et al. |

FOREIGN PATENT DOCUMENTS

| | | | |
|---|---|---|---|
| CN | 2561093 | Y | 7/2003 |
| CN | 1589593 | A | 3/2005 |

(Continued)

*Primary Examiner* — Tuyet Thi Vo

(57) ABSTRACT

A wake-up lighting device is described, comprising a gas discharge lamp (10) and a lamp driver (1; 2) comprising a power source (100) capable of generating spaced-apart current bursts (51) of alternating lamp current (I). The wake-up lighting device is capable of operating in an off-mode in which no lamp current is generated, and is adapted to switch from its off-mode to a wake-up mode in which the power source (100) operates to:—initially generate an alternating lamp current (I) with a minimum duty cycle value (ΔT) and a reduced current amplitude (IR) close to zero;—subsequently gradually increase the current amplitude while keeping the duty cycle (Δ) constant at the minimum duty cycle value (ΔT), until the current amplitude reaches a nominal current amplitude (IM);—subsequently gradually increase the duty cycle (Δ) while keeping the current amplitude constant at the nominal current amplitude (IM).

22 Claims, 10 Drawing Sheets

FOREIGN PATENT DOCUMENTS

| | | | |
|---|---|---|---|
| CN | 1829398 | A | 9/2006 |
| EP | 1708549 | A2 | 10/2006 |
| EP | 1737281 | A2 | 12/2006 |
| GB | 2325099 | A | 11/1998 |
| JP | 11111218 | A | 4/1999 |
| JP | 2000149876 | A | 5/2000 |
| JP | 2003346551 | A | 12/2003 |
| JP | 2004165090 | A | 6/2004 |
| WO | 2007004191 | A1 | 1/2007 |
| WO | 2007113745 | A1 | 10/2007 |
| WO | 2007141676 | A1 | 12/2007 |

VARIABLE LIGHT-LEVEL PRODUCTION USING DIFFERENT DIMMING MODES FOR DIFFERENT LIGHT-OUTPUT RANGES

The present invention relates in general to the field of fluorescent lamps, more particularly a dimmable light generating device comprising a fluorescent lamp.

There is a general tendency to replace the traditional incandescent lamps by other types of light sources, such as LEDs and gas discharge lamps. LEDs and gas discharge lamps have, with respect to each other, some advantages and disadvantages, and a designer may choose to use either an LED or a gas discharge lamp, depending on his design considerations.

A light source, be it an incandescent lamp, an LED or a gas discharge lamp, is designed for nominal operation with a nominal lamp voltage and a nominal lamp current, resulting in a nominal lamp power and a nominal light output. If, in a certain situation, a user wishes to have more light, he may replace the current lamp by a more powerful lamp, or by a lamp of a different type having a higher light output. Conversely, if a user wishes to have less light, he may replace a lamp by another lamp having a smaller light output. However, this is very cumbersome, so there is a general desire to be able to dim a lamp, i.e. to drive a lamp with a power below its nominal power such that the light output is less than the nominal light output.

The present invention relates particularly to the field of driving a gas discharge lamp at reduced power, i.e. in a dimmed state.

A gas discharge lamp has a negative resistance characteristic, and therefore a ballast device is needed for driving the lamp. Although, in principle, it is possible to drive a gas discharge lamp with DC current, an electronic ballast typically provides a high frequency lamp current. Dimming can for instance be achieved by reducing the magnitude of the lamp current, or by switching the lamp on and off at a certain duty cycle.

Several problems and disadvantages are associated with the different mechanisms for dimming a gas discharge lamp, depending among others on the specific use, especially if it is desirable that the lamp is dimmed to a very low level of less than 1% of the nominal light output. A particular light generating device to which the present invention relates is a so-called wake-up light, which is a device which, triggered for instance by a clock, gradually increases its light output from zero to maximum. One of the problems for such an application is associated with ignition. For ignition, a gas discharge lamp requires a relatively high voltage. As a result, if the lamp is to be ignited in the dimmed condition with a light output close to zero, the lamp may produce a light flash on ignition and then reduce its light output to the desired dim level. Such a light flash is undesirable.

A further problem is that it is very difficult to maintain lamp stability at a very low dim level.

A further problem is associated with color: it has been found in practice that a lamp whose light output is being reduced may change the color of that light output.

In the case of gas discharge lamps having filament electrodes, the electrodes need to be supplied by an electrode heating current in order to keep the electrodes at an optimum operative temperature. However, in typical electronic ballasts, the filaments are only heated in the ignition phase, and during dimming the temperature of the filaments may become too low. Thus, it may be necessary to provide a separate electrode heating circuit, but such circuits tend to be complex and relatively expensive. In relatively simple embodiments, the electrode heating circuits derive their power from the lamp voltage, which typically involves a DC voltage derived from rectified mains and therefore susceptible to mains voltage variations. In the case of dimming by reducing the magnitude of the lamp current, the derived heating power will also be reduced. In the case of duty cycle dimming, the lamp voltage is interrupted regularly, which would interrupt the electrode heating. Thus, the electrode heating may vary in practice, which is undesirable. If the electrode is heated too much, the cathode temperature will be too high, the cathodes will lose emitter material (barium), and after some time the lamp will burn with a reddish glow; if the electrode is heated insufficiently, the cathode temperature will be too low, and the lamp will become blackened very rapidly. In both cases, the consequence will be a substantially reduced lifetime of the electrodes to possibly only a few hours (insufficient heating) or a few hundreds of hours (over-heating).

In a linear gas discharge lamp, the electrodes are arranged at opposite ends of a longitudinal lamp tube. In the case of a so-called compact gas discharge lamp, the lamp tube can be considered as being folded, so that the lamp comprises an even number of tube segments arranged parallel next to each other, while the lamp ends with the lamp electrodes are located next to each other at the same longitudinal end of the lamp. In such a lamp type, in the case of application as wake-up light with very low dim levels, an instability problem may occur in that the lamp, upon the start of the wake-up sequence, will only emit light from lamp portions close to the electrodes, which portions relatively slowly grow in a direction away from the electrodes towards the other end of the lamp, while the intermediate tube segments do not emit light.

The present invention specifically aims to provide a solution to these problems. Particularly, the present invention aims to provide a design for a gas discharge lamp and a design for an electronic driver for driving this lamp, such that the lamp can be driven to emit extremely low light levels close to zero lux, while the nominal light output may be in the order of about 300 lux.

US patent application 2006/0214605 discloses a method of dimming a fluorescent lamp. In nominal operation (i.e. 100% light output), the lamp is driven with an alternating lamp current at a constant amplitude and a relatively high frequency. When dimming the lamp, the lamp current amplitude is modulated with a saw tooth having a certain modulation frequency lower than the alternating current frequency, so that the current amplitude, in each saw tooth period, is slowly reduced from a maximum value to a minimum value. When dimming further, the minimum value is reduced but the maximum value is maintained. For further dimming, once a certain dimming level has been reached, the maximum value and the minimum value are both reduced, while the modulation depth is maintained constant, until the minimum value reaches a limiting value equal or close to zero. For still further dimming, the minimum value is maintained constant but the maximum value is reduced, while the ramp angle of the saw tooth is maintained constant, so that in each saw tooth period the duration of a current portion having the minimum value is increased and the actual saw tooth portion is narrowed.

One disadvantage of this known technique is that, over a large dimming range, current of less than nominal value is used, resulting in a deviation of the color. Further, a disadvantage is that this known technique requires amplitude modulation means.

It is a specific objective of the present invention to provide a dimming method and apparatus capable of providing dimming over a large range, using relatively simple means of implementation, and yielding a substantially constant color of the light emitted.

It is a further specific object of the present invention to provide an apparatus for dimming a lamp, provided with relatively simple means enabling substantially constant heating of the electrodes, independent of the dimming level.

To this end, the present invention proposes to apply duty cycle dimming with a constant lamp current amplitude in a first dim range between nominal light output and a predefined dimming threshold, and to apply amplitude dimming with a constant duty cycle in a second dim range below said dimming threshold. The dimming threshold may for instance be a light output level of about 0.5%, and the second dim range may for instance be between the dimming threshold and a light output level of 0.01% or even lower.

Further advantageous elaborations are mentioned in the dependent claims.

These and other aspects, features and advantages of the present invention will be further explained by the following description of one or more preferred embodiments with reference to the drawings, in which same reference numerals indicate same or similar parts, and in which.

Figure 9A:
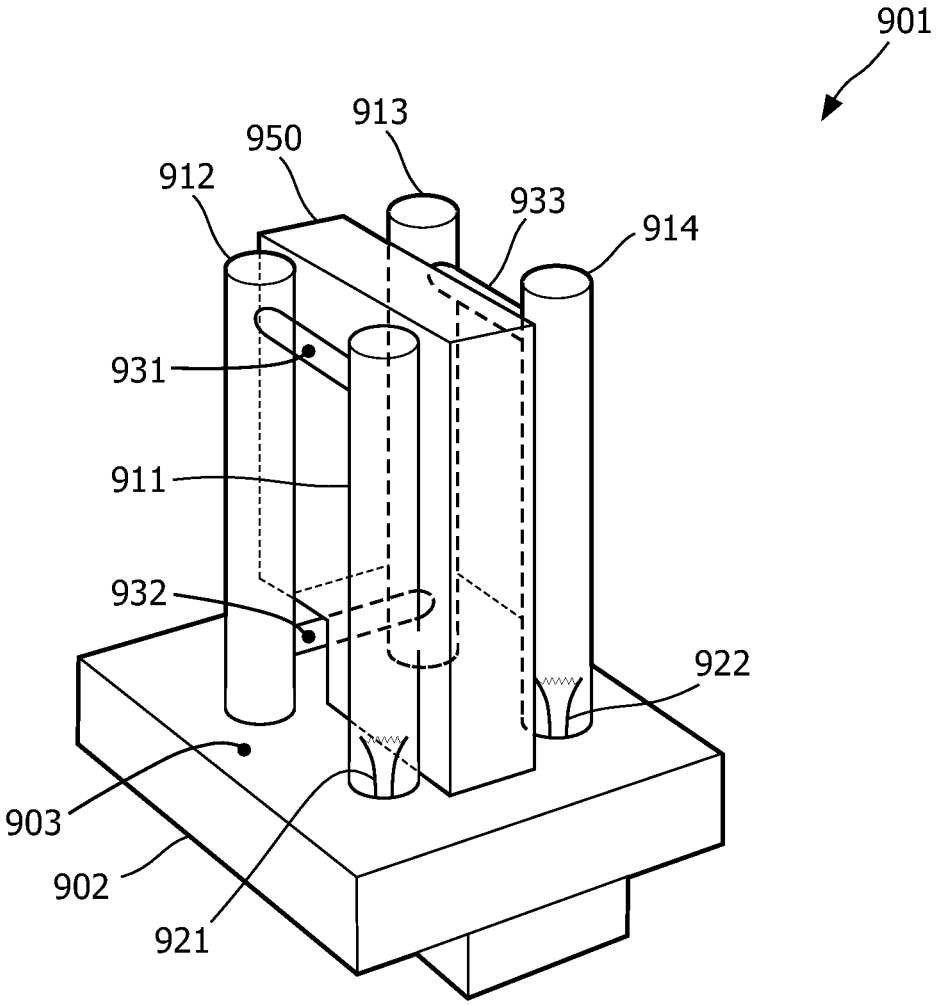
Figure 9B:
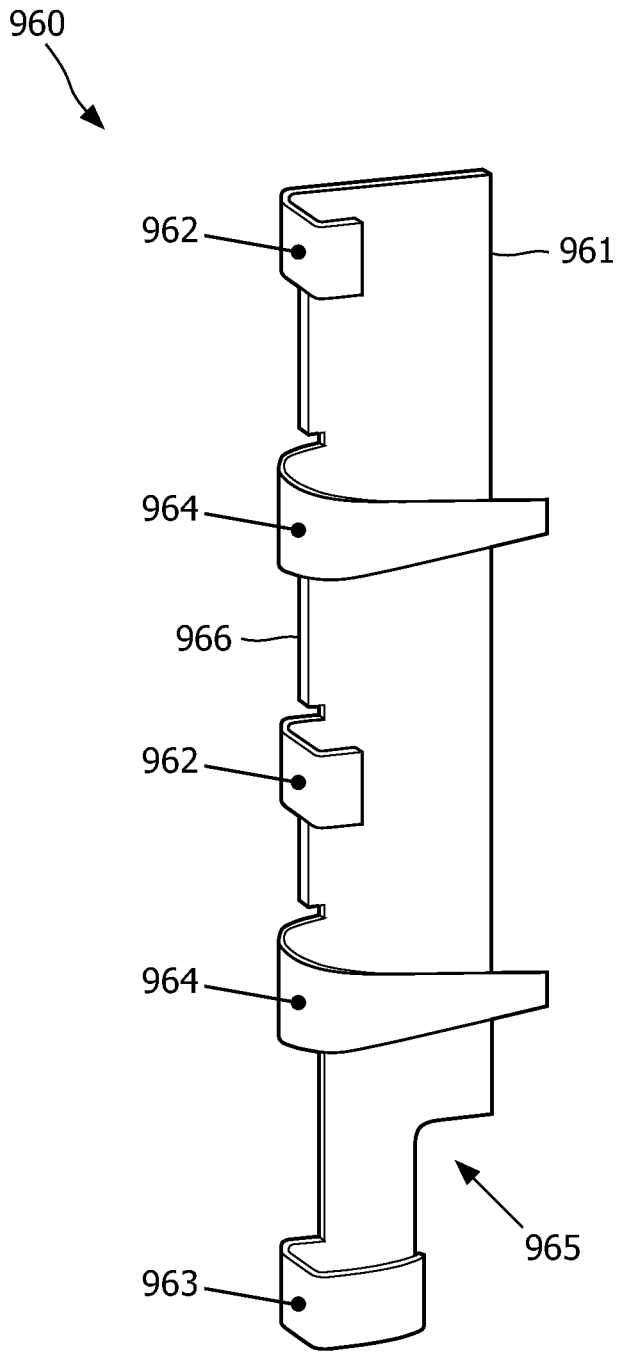

FIG. 9A schematically shows a perspective view of a compact gas discharge lamp;

FIG. 9B is a schematic perspective view of a preferred embodiment of an external electrode according to the present invention.

Figure 1:
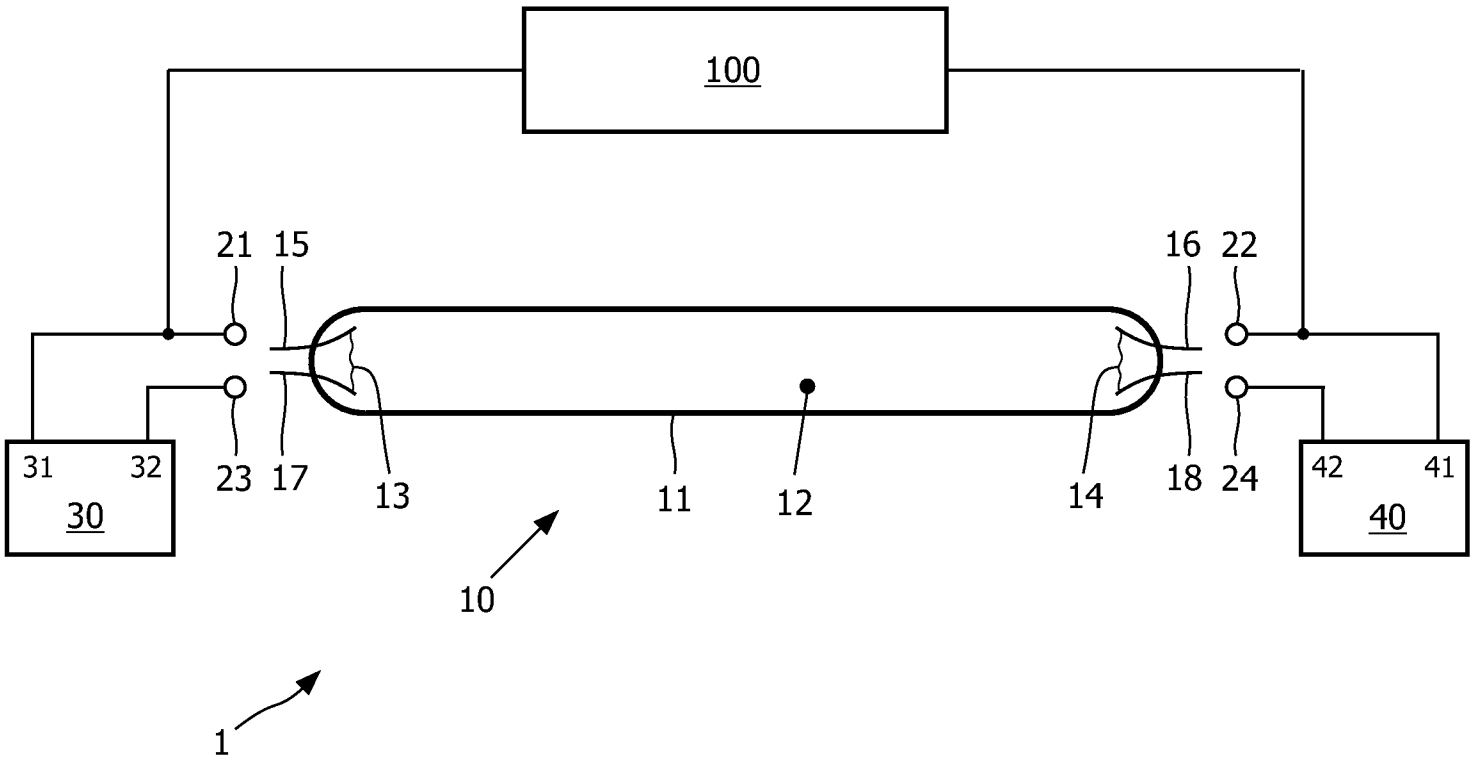
FIG. 1 is a block diagram schematically illustrating an electronic driver.

FIG. 1 is a block diagram schematically illustrating some features of an electronic driver 1 for driving a gas discharge lamp 10. The lamp 10 is a hot cathode fluorescent lamp, and comprises a lamp tube 11 having an interior space 12 and two electrode filaments 13, 14 arranged within the interior space 12, indicated as first and second electrode filaments 13, 14, respectively. Each electrode filament is provided with two electrode terminals 15, 17 and 16, 18, respectively, extending to the exterior beyond the lamp tube 11.

The driver 1 has output terminals 21, 22, 23, 24 connected to the lamp electrode terminals 15, 16, 17, 18, respectively. Particularly, a first output terminal 21 is connected to a first electrode terminal 15 of the first lamp electrode filament 13, a second output terminal 22 is connected to a first electrode terminal 16 of the second lamp electrode filament 14, a third output terminal 23 is connected to a second electrode terminal 17 of the first lamp electrode filament 13, and a fourth output terminal 24 is connected to a second electrode terminal 18 of the second lamp electrode filament 14.

The driver 1 comprises a main power source 100 for generating lamp current, particularly pulsed lamp current, wherein the pulse width can be varied in order to vary the duty cycle and thus the average light output. A first main output terminal 101 of the main power source 100 is connected to the first driver output terminal 21 and hence to the first electrode terminal 15 of the first lamp electrode filament 13, and a second main output terminal 102 of the main power source 100 is connected to the second driver output terminal 22 and hence to the first electrode terminal 16 of the second lamp electrode filament 14.

The driver 1 further comprises electrode heating means 30, 40 for heating the lamp electrode filaments 13, 14. Particularly, a first electrode-heating power source 30 for generating electrode heating current for the first lamp electrode filament 13 has first output terminals 31, 32 connected to the first and third driver output terminals 21, 23, respectively, for supplying the first lamp electrode filament 13 with electrode heating current. Likewise, a second electrode-heating power source 40 for generating electrode heating current for the second lamp electrode filament 14 has second output terminals 41, 42 connected to the second and fourth driver output terminals 22, 24, respectively, for supplying the second lamp electrode filament 14 with electrode heating current.

Figure 2:
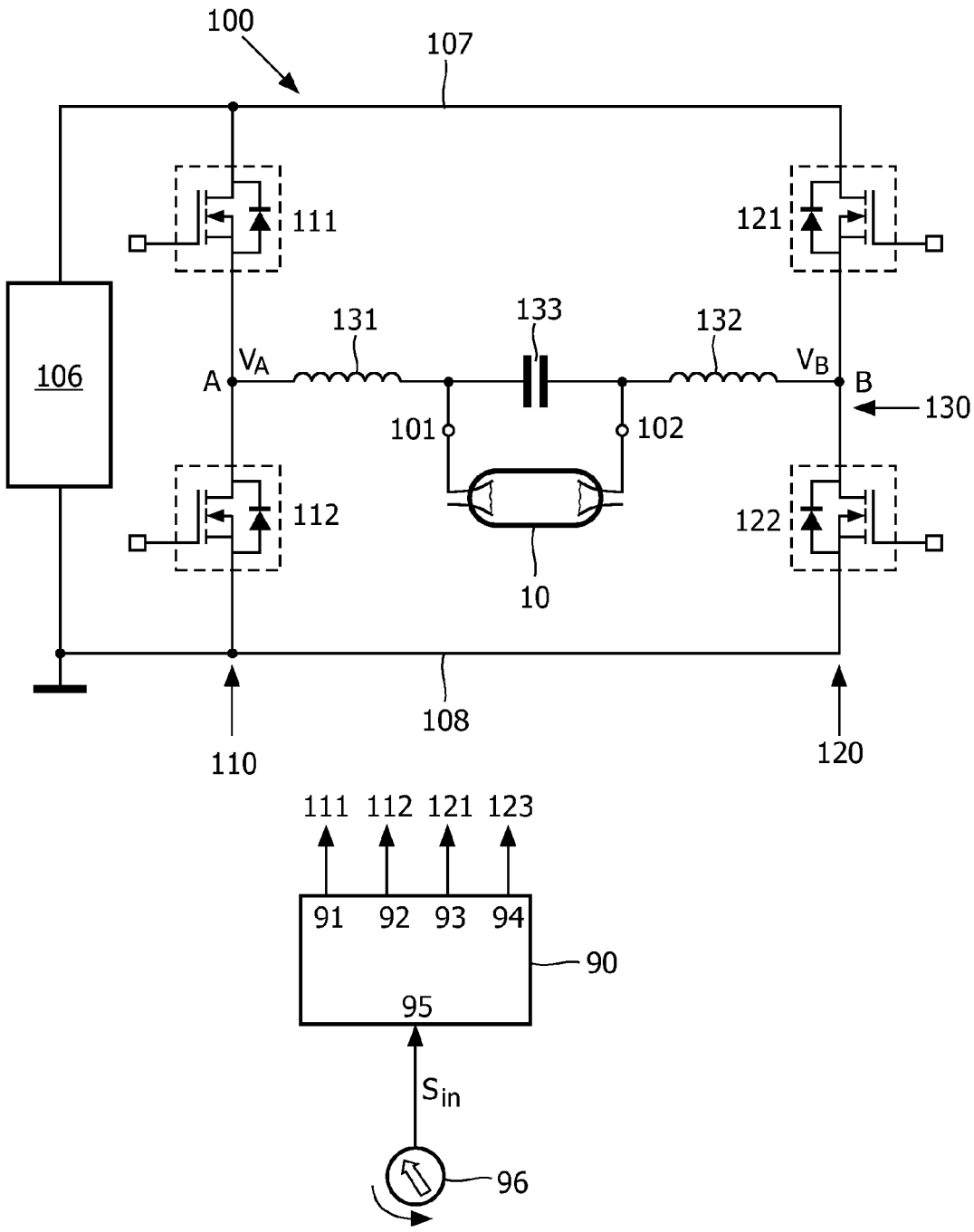
FIG. 2 is a block diagram schematically illustrating a main power source for a driver.

FIG. 2 is a block diagram schematically illustrating details of an embodiment of the main power source 100. In FIG. 2, the two electrode heating power sources 30, 40 are not shown, for the sake of simplicity. It is noted that electrode heating power sources for generating electrode heating current are known per se.

The main power source 100 has a full bridge topology arranged between first and second DC power lines 107, 108. A first bridge leg 110 includes a first series arrangement of two controllable switches 111, 112 connected between said first and second DC power lines 107, 108 with a first bridge output node A between these two switches. A second bridge leg 120 includes a second series arrangement of two controllable switches 121, 122 connected between said first and second DC power lines 107, 108 with a second bridge output node B between these two switches. A bridge diagonal 130 is connected between said two output nodes A and B, and includes a series arrangement of inductive means 131, 132 and capacitive means 133. For the sake of symmetry, the inductive means comprises a series arrangement of a first inductor 131 and a second inductor 132, with the capacitive means 133 arranged between said two inductors. The main output terminals 101, 102 of the main power source 100 are arranged in parallel with said capacitive means 133. The first and second DC power lines 107, 108 are connected to a source 106 of DC voltage, typically rectified mains.

The main power source 100 further comprises a controller 90 having control outputs 91, 92, 93, 94 connected to control terminals of the corresponding switches 111, 112, 121, 122. The controller 90 generates control signals for the two controllable switches 111, 112 of the first bridge leg 110 such that either the first switch 111 is open (non conductive) while the second switch 112 is closed (conductive) or the first switch 111 is closed while the second switch 112 is open. These switches are opened/closed at substantially the same moment, with a slight delay in order to prevent that these switches are both closed at the same moment. Both switches are operated at a duty cycle of 50%, so that they are open as long as they are closed. The switching frequency, hereinafter indicated as bridge switching frequency, may by way of example be in the order of 100 kHz.

Figure 3A:
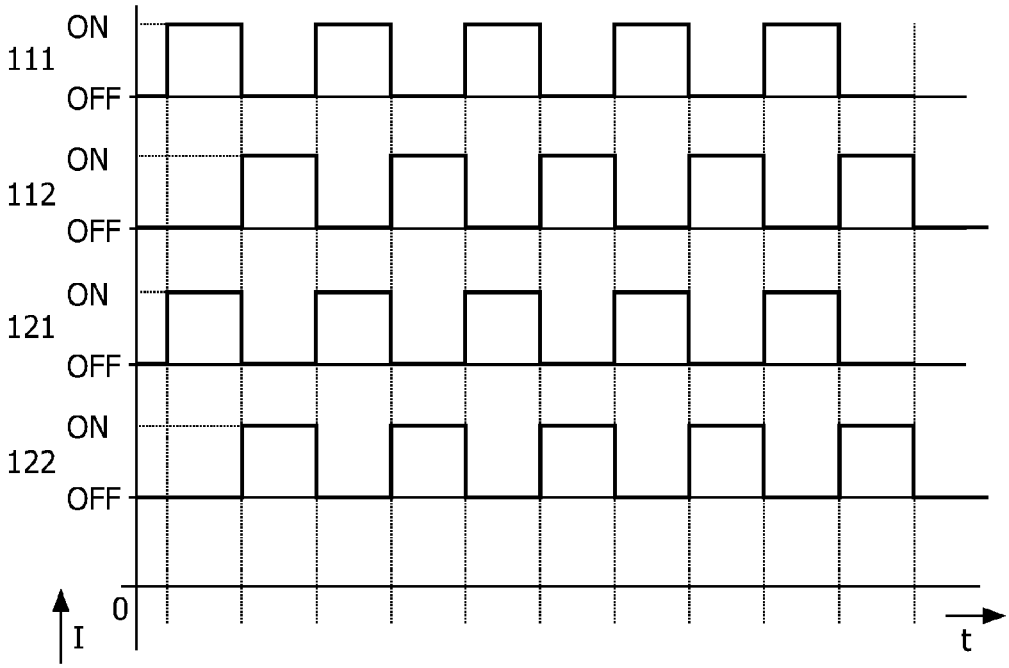
FIGS. 3A-3B are graphs scheme illustrating the operation of a lamp current source of the driver according to an embodiment of the present invention.
Figure 3B:
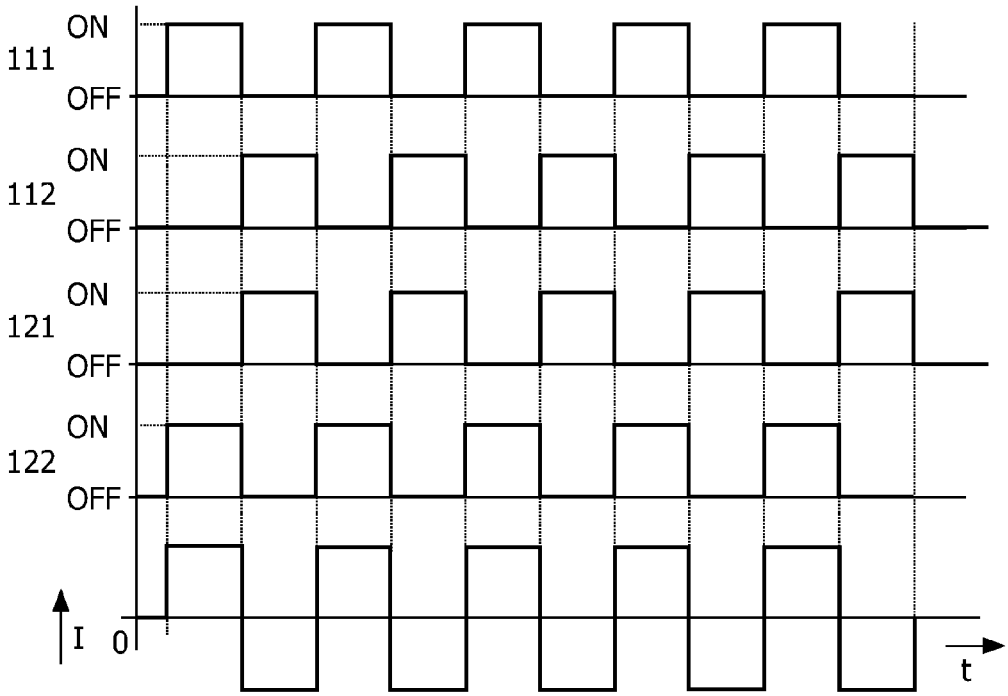

The controller 90 generates control signals for the two controllable switches 121, 122 of the second bridge leg 120 in a similar manner. The switching frequency for the second bridge leg 120 is exactly the same as for the first bridge leg 110. As an operating parameter, the controller 90 can vary the phase difference $\Delta\phi$ between the two legs 110, 120. If the two legs 110, 120 are operated exactly in phase ($\Delta\phi=0°$), nodes A and B will always have mutually the same potential, so there will be no current flowing in the lamp 10; this situation is illustrated in FIG. 3A. If the two legs 110, 120 are operated exactly out of phase ($\Delta\phi=180°$), nodes A and B will alternatively be at opposite supply line voltage potentials, and an alternating lamp current I having the switching frequency will flow in the lamp 10; this situation is illustrated in FIG. 3B. In a first state, the first and fourth switches 111, 122 are closed (conductive; ON) and the second and third switches 112, 121 are open (OFF): in that case, lamp current will flow from node A to node B (indicated as positive current in FIG. 3B). In the second state, the first and fourth switches 111, 122 are open and the second and third switches 112, 121 are closed, so that lamp current flows from node B to node A (indicated as negative current in FIG. 3B). Inductors 131 and 132 and capacitor 133 operate as a resonant circuit, and the amplitude $I_M$ of the lamp current depends on the switching frequency. It is noted that this current is shown as a block current for the sake of simplicity, and not for displaying a realistic representation.

Figure 4A:
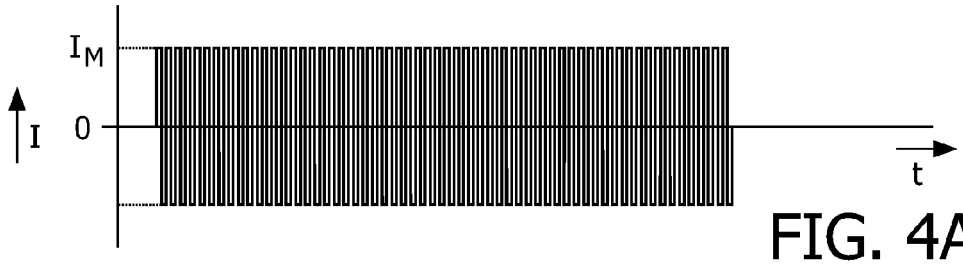
FIGS. 4A-4E are time graphs illustrating the dimming operation of the driver according to an embodiment of the present invention.

FIG. 4A is a graph schematically illustrating lamp operation in the case of maximum light output. The horizontal axis represents time; the vertical axis represents lamp current. The two bridge legs 110, 120 are continuously operated at 180° phase difference, so that a high frequency lamp current of substantially constant magnitude $I_M$ is constantly generated.

The controller 90 has an input terminal 95 for receiving an input signal Sin indicating a desired dim level of the lamp. In an illustrative example, the input signal Sin may be generated by a user-actuated rotating device 96 comprising for instance a potentiometer. It is noted that the input signal Sin may alternatively be generated by a controlling device, for instance a timer, external to the controller 90 or integral with the controller 90. In the case of a wake-up light, the desired input level will gradually rise from zero to 100% within a predetermined time, typically in the order of about 30 min.

Figure 4B:
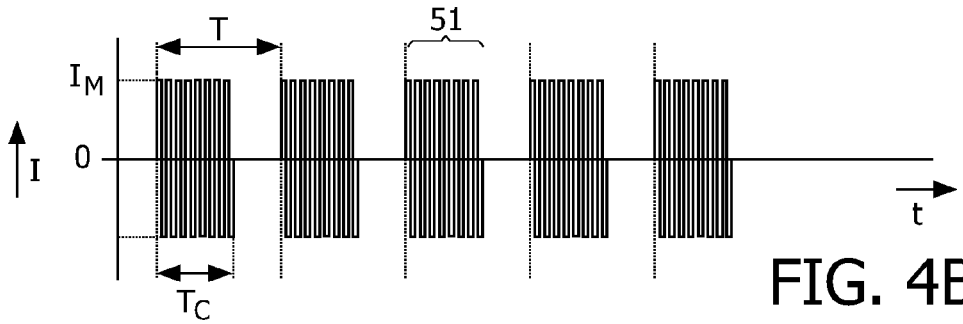

If the user wishes to reduce the light output, the controller 90 starts operating in a duty cycle mode, illustrated in FIG. 4B, which is a graph comparable to that of FIG. 4A. In this duty cycle mode, the controller periodically switches the phase difference $\Delta\phi$ between 0° and 180°, at a repetition frequency (for instance in the order of about 100 Hz) lower than the bridge switching frequency (for instance in the order of about 100 kHz), so that the lamp is alternately provided with zero lamp current ($\Delta\phi=0°$) and a burst 51 of alternating lamp current of substantially constant current magnitude equal to the nominal current magnitude $I_M$ ($\Delta\phi=180°$). In FIG. 4B, the duration of the switching period is indicated as T, while the duration of a current burst 51 of alternating lamp current is indicated as $T_C$. A duty cycle $\Delta$ is defined as $\Delta=T_C/T$.

It is noted that, during the current bursts when the phase difference $\Delta\phi$ equals 180°, a duty cycle is equal to 50%, meaning that the current flows in one direction during an equally long time as in the opposite direction. On a larger time scale, the average current $I_{AV}$ can be expressed as $I_{Av}=\Delta\cdot I_M$. Since the average light output is proportional to the average current, the average light output $L_{AV}$ can be expressed as $L_{AV}=\Delta\cdot L_M$, with $L_M$ indicating the nominal or maximal light output.

Thus, the light output can be varied (dimmed) by varying (reducing) the duty cycle $\Delta$. An important advantage of the invention is that light output is only generated during the current bursts, while there is substantially no light output in the time periods between the current bursts. Since in the current bursts the current always maintains the nominal magnitude, the light output characteristics during the current bursts are always equal to the nominal light output characteristics; particularly the color of the light remains constant. By operating the lamp in spaced apart current bursts, the light is actually "diluted" in time, i.e. dimmed in intensity, but remains the same in all other aspects.

Figure 4C:
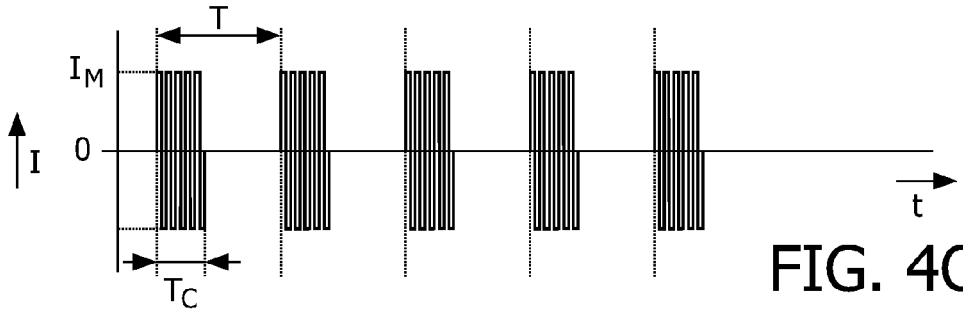

Further dimming is achieved by reducing the duty cycle. FIG. 4C is a graph, comparable to FIG. 4B, of a situation with further reduced light output.

Figure 4D:
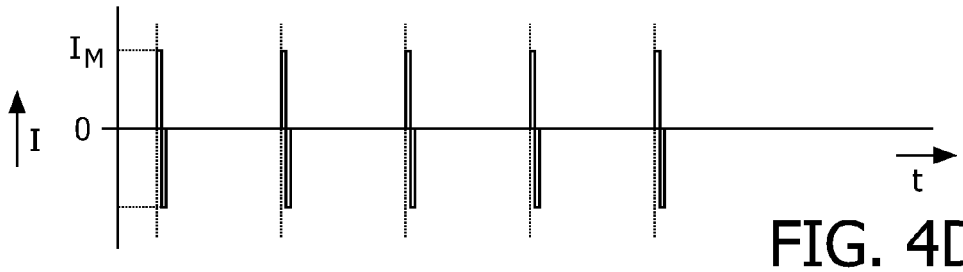

Further dimming by reducing the duty cycle $\Delta$ is performed until the duty cycle $\Delta$ reaches a predefined threshold $\Delta_T$. This situation is schematically illustrated in FIG. 4D. The threshold duty cycle $\Delta_T$ is not critical, but may for instance be in the order of 1%, or even lower, for instance 0.5%. With $\Delta=\Delta_T$, the average light output $L_{AV}$ can be expressed as $L_{AV}=\Delta_T\cdot L_M$.

In a possible embodiment, the threshold $\Delta_T$ corresponds to the lamp current running through just one entire commutation cycle, as illustrated in FIG. 4D. In a practical embodiment, with a bridge switching frequency of 100 kHz and a repetition frequency of 100 Hz, the threshold $\Delta_T$ may be selected to be equal to 1%, which corresponds to bursts 51 containing 10 bridge switching cycles. With a further reduction of the duty cycle, small variations in the duty cycle, due to for instance the accuracy of the controller, which are difficult to avoid, may result in visible variations of the light output.

Figure 4E:
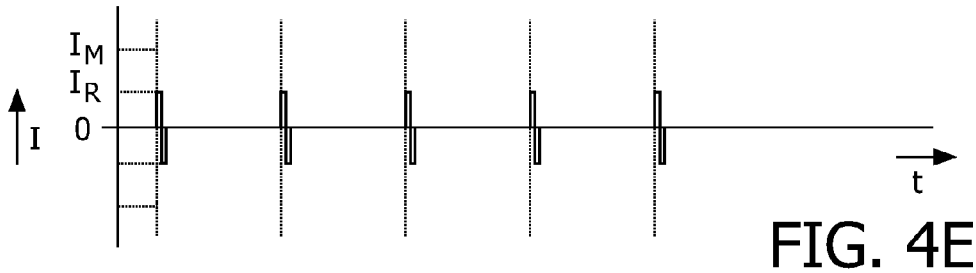

If the user wishes to reduce the light output still further, the controller 90 maintains the duty cycle equal to $\Delta=\Delta_T$, but reduces the current magnitude I to a value $I_R$ lower than the nominal value $I_M$, as illustrated in FIG. 4E. Any deviation of the light output characteristics, particularly the color of the light, thus only occurs for very small light outputs, where such a deviation would be more acceptable.

Figure 5:
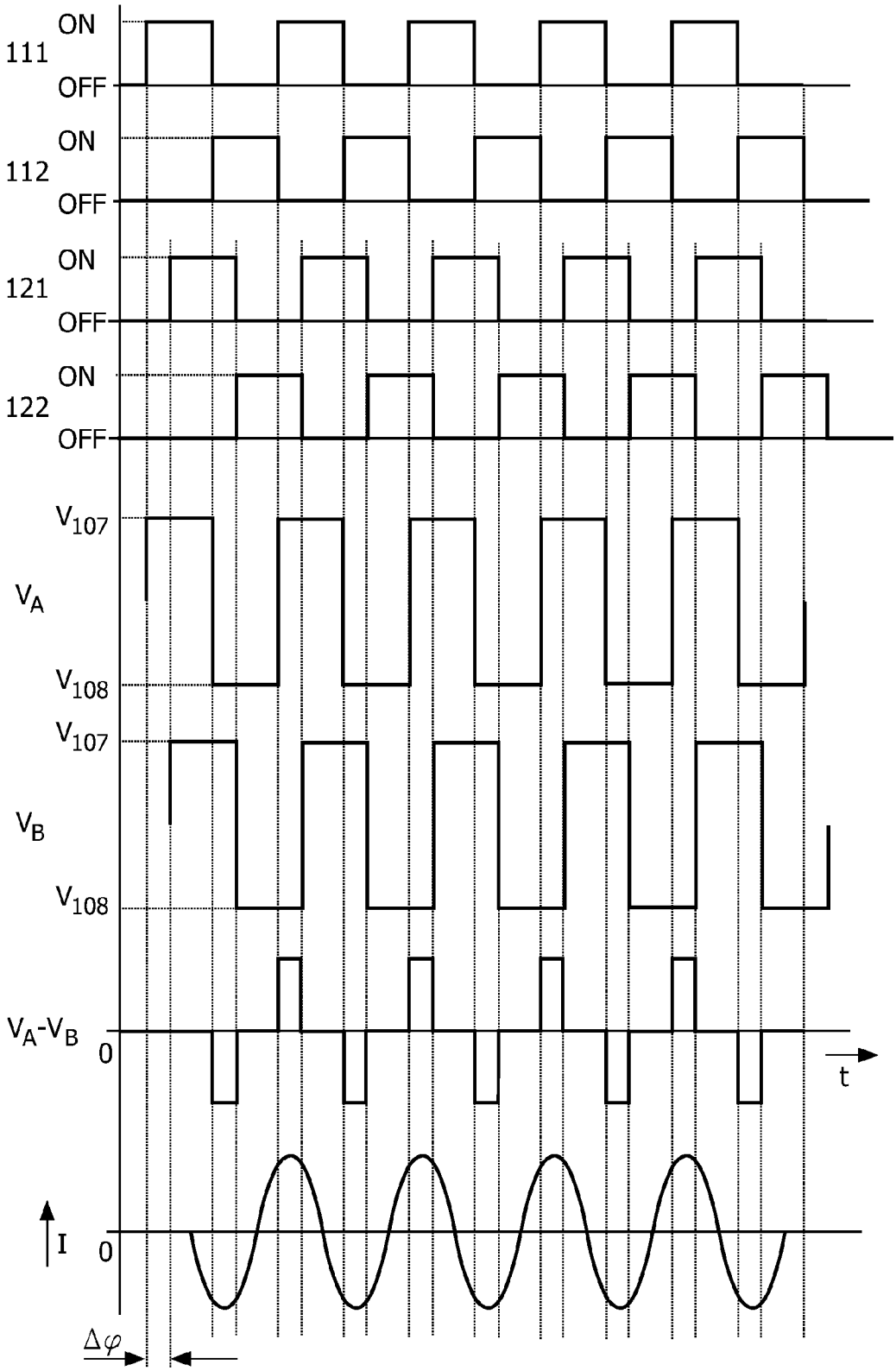
FIG. 5 is a time graph illustrating the operation of a bridge with variable phase difference between the bridge legs.

Reducing the current magnitude can be effected by reducing the output of power source 106. This, however, requires a controllable power source. In a preferred embodiment, the current magnitude is varied by varying the phase difference $\Delta\phi$ between the two bridge legs 110, 120. This principle is illustrated in FIG. 5. In the upper part of this graph, it can be seen that the switches 111, 112 of the first bridge leg 110 are switched with a duty cycle of 50% and a phase difference of 180° with respect to each other, that the switches 121, 122 of the second bridge leg 120 are switched with a duty cycle of 50% and a phase difference of 180° with respect to each other, and that there is a phase difference $\Delta\phi$ between the two legs 110, 120. The graph further shows the voltage at node A to alternate between the voltage of the first DC power line 107 and the second DC power line 108, and shows the voltage at node B to also alternate between the voltage of the first DC power line 107 and the second DC power line 108, with the same phase difference $\Delta\phi$ between these two voltages. The graph further shows the voltage difference $V_A-V_B$ between these two nodes A and B, which voltage difference drives the lamp current I.

Due to the very small duty cycle of the lamp voltage, the lamp does not get the opportunity to ignite and operates only capacitively. Thus, the lamp offers a relatively large impedance, and the behavior of the circuit is mainly determined by the resonant tank (131, 132, 133 in FIG. 2). As the circuit between nodes A and B is resonant, while the switching frequency of the bridge legs is close to the resonance frequency, the current in the bridge diagonal 130 between nodes A and B is a sine-shaped current approximately in phase with the voltage over nodes A and B. Thus, the voltage developing over the parallel capacitor 133 (FIG. 2) is a sine-shaped voltage approximately in phase with the voltage over nodes A and B; since this voltage determines the lamp current, also the capacitive lamp current is a sine-shaped current approximately in phase with the voltage over nodes A and B, as illustrated schematically by the lowermost curve in FIG. 5.

The capacitive lamp current does cause some light to be generated. It should be clear to a person skilled in the art that the maximum current magnitude attained in this way (peaks of the current curve) is proportional to the phase difference $\Delta\phi$ in the range of $0° \leqq \Delta\phi \leqq 180°$. Likewise, the average of the current magnitude is proportional to the phase difference $\Delta\phi$. Thus, by varying the phase difference $\Delta\phi$, it is possible to vary the average current magnitude and thus the light output.

It is noted that, with a higher duty cycle and therefore a higher light output, the lamp does achieve ignition, in which case the lamp current is more triangular in shape.

In the case of a wake-up light, the operation by the controller 90 is exactly opposite. In an initial state, the lamp is off. At a certain moment in time, for instance determined by a clock, the controller starts its operation with the duty cycle set to $\Delta=\Delta_T$ and the current magnitude close to zero (FIG. 4E) by setting the leg phase difference $\Delta\phi$ close to 0°. As a function of time, the controller increases the current magnitude, by increasing the leg phase difference $\Delta\phi$ while maintaining the duty cycle constant, until the current magnitude has reached the nominal value $I_M$ (FIG. 4D) because the leg phase difference $\Delta\phi$ reached 180°. From that moment on, still as a function of time, the controller increases the duty cycle while maintaining the current magnitude constant (FIGS. 4C and 4B), until finally the duty cycle becomes equal to 100%. This wake-up operation is schematically illustrated in FIG. 6, in which the upper graph shows the phase difference $\Delta\phi$ as a function of time while the lower graph shows the duty cycle as a function of time.

Figure 6:
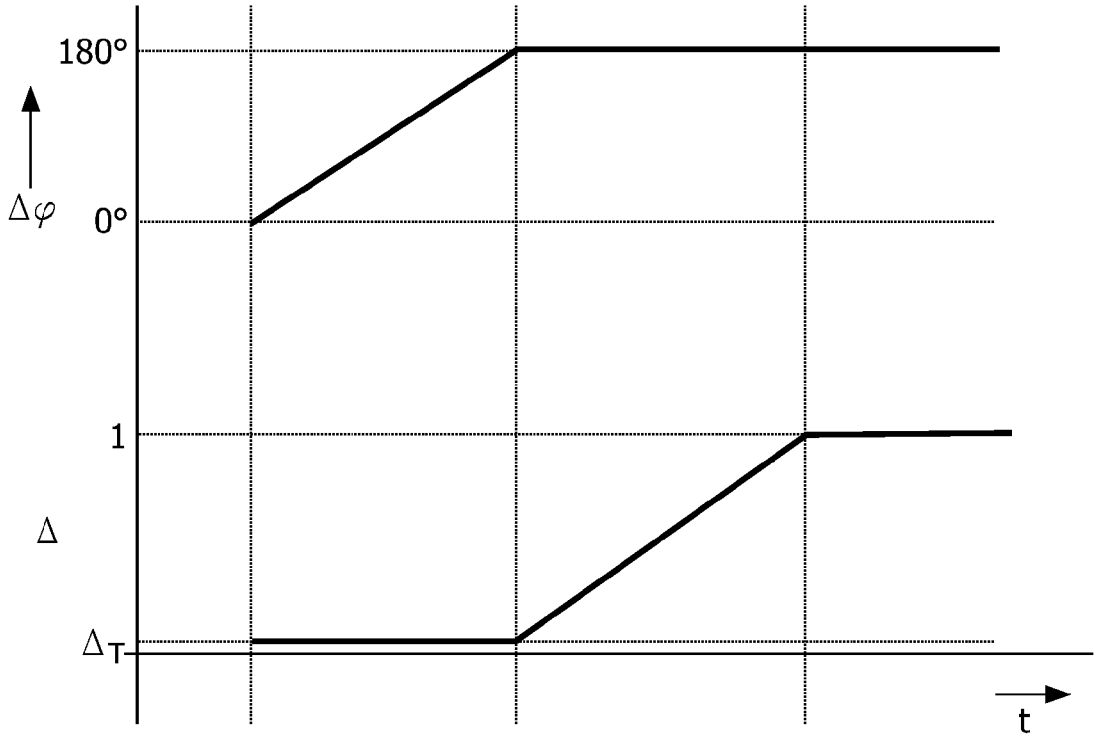
FIG. 6 is a time graph illustrating the operation of a wake-up light according to an embodiment of the present invention.

It is noted that, in FIG. 6, the phase difference $\Delta\phi$ and the duty cycle are shown to increase linearly as a function of time. However, according to design considerations, the second time-derivative of these parameters may be unequal to zero; for instance, the phase difference $\Delta\phi$ and the duty cycle may increase exponentionally.

It is further noted that the implementation of the dimming procedure or the wake-up procedure as mentioned above can easily, and at low cost, be achieved by a suitable programming of the controller 90, i.e. a software implementation.

As mentioned before, the electrode-heating power sources 30, 40 may be implemented as separate constant current sources. In that case, during the time periods when no lamp current is flowing, it is possible that the controller 90 keeps all switches 111, 112, 121, 122 in the OFF state. However, for the case when the duty cycle variations and the current magnitude variations are implemented by leg phase difference variations as described above, the present invention provides a relatively simple implementation for an electrode-heating power source, deriving its power from the nodes A or B, respectively.

Figure 7:
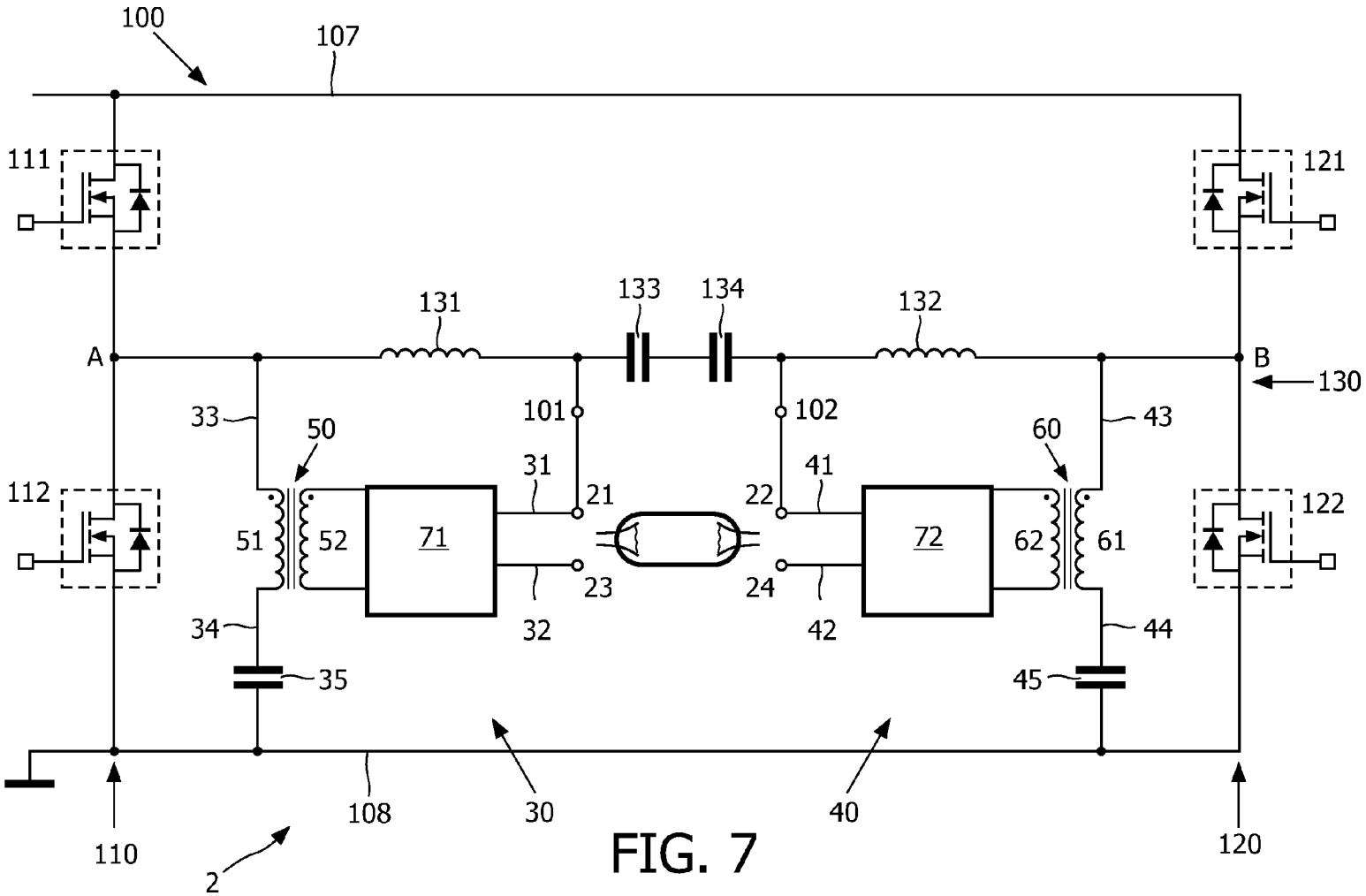
FIG. 7 is a block diagram schematically illustrating a preferred embodiment of an electronic driver with electrode heating means.

FIG. 7 is a block diagram, comparable to FIG. 2, of a driver 2 adapted according to the present invention, wherein specifically the electrode heating power sources 30, 40 are implemented according to the present invention. For the sake of simplicity, the controller 90 and the DC power source 106 are not shown in FIG. 7. It is noted that the capacitive means parallel to the lamp 10 is implemented as a series arrangement of two capacitors 133, 134.

The first electrode-heating power source 30 comprises a first transformer 50, having a primary transformer winding 51 coupled between a first input terminal 33 and a second input terminal 34, and having a secondary transformer winding 52 coupled to the output terminals 31, 32 of the first electrode-heating power source 30. In the preferred embodiment shown, a voltage regulator 71 is coupled between the secondary transformer winding 52 and the output terminals 31, 32. The second input terminal 34 is coupled to the ground line 108 through a capacitor 35, designed for DC-decoupling. The capacitance of this decoupling capacitor 35 is chosen relatively high in relation to the switching frequency and the inductance of the primary transformer winding 51, so that in practice any voltage ripple over this capacitor will be practically zero.

Likewise, the second electrode-heating power source 40 comprises a first transformer 60 having a primary transformer winding 61 coupled between a first input terminal 43 and a second input terminal 44 and having a secondary transformer winding 62 coupled to the output terminals 41, 42 of the second electrode heating power source 40. In the preferred embodiment shown, a voltage regulator 72 is coupled between the secondary transformer winding 62 and the output terminals 41, 42. The second input terminal 44 is coupled to the ground line 108 through a second decoupling capacitor 45.

Because the lamp is not connected directly to the bridge nodes A and B, the two HF transformers 50, 60 act as level shifters. The series capacitors 35, 45 have the effect that the DC offset constitutes no problem as regards driving the primary transformer windings 51, 61.

The HF transformers 50, 60 convert the high voltage at the bridge nodes A, B to a much lower voltage suitable for lamp cathode heating. Typical cathode heating ratings are 4V and 320 mA for a 26 W PL-C lamp. It is very important that the cathode heating power is maintained as constant as possible at the correct values, which are lamp-dependent. If the heating output voltage is too high, the cathode temperature will be too high, the cathode will lose emitter material (typically barium), and the lifetime of the lamp will be reduced to several hundred hours. If the heating output voltage is too low, the cathode temperature will be too low, causing the cathode to blacken and the lifetime of the lamp to be reduced to just a few hours. It is noted that the bridge nodes A and B continuously carry the high-frequency high voltage as shown in FIG. 5, so that the transformers 50, 60 and hence the lamp electrodes 14 are supplied with a constant voltage.

In order to enhance the accuracy of the cathode heating voltage, each electrode-heating power source 30, 40 preferably comprises, as shown, a voltage regulator 71, 72, each comprising a rectifier (for instance a diode bridge), a buffer (for instance a capacitor), and a stabilizer. This may be advisable to cancel possible variations of the output voltage of the DC power source 106. However, if the DC power source 106 provides a sufficiently stable voltage, such voltage regulators may be dispensed with.

In the driver according to the present invention, the electrode heating power is maintained substantially constant, irrespective of the duty cycle set by the controller for setting a dim level, and irrespective of the lamp current magnitude set by the controller for setting a dim level.

In the above, the operation of the switches 111, 112, 121, 122 has been described with a view to the generation of the lamp current and with a view to the generation of the heating current only. In this respect, the exact timing of the switching is not essential, apart from the fact that there must be some "dead time" between the ON periods of two switches arranged in series in order to prevent short circuiting. If this condition is met, the exact timing of when the next switch is turned conductive is not essential. However, in a preferred embodiment, it is assured that the voltage over a switch has become zero before this switch is turned conductive, because otherwise power losses occur due to the switching. By way of explanation, a more detailed description will be given of the switching of switches 111 and 112.

Let it be assumed that in a first stage first switch 111 is ON and second switch 112 is OFF. A current is flowing through the first switch 111 and the primary transformer winding 51, node A being at the high voltage of line 107.

In a second stage, both switches 111 and 112 are OFF. The current continues to flow in the primary transformer winding 51, a current path being closed by the body diode of MOSFET 112 (or a separate diode arranged in parallel with the switch 112). As a result, the voltage at node A drops. It is noted that this can be seen as discharging a load capacitor (not shown) in parallel with the second switch 112. This load capacitor can be constituted by a parasitic capacitance between drain and source of the MOSFET 112, or a capacitive component of the load attached to node A, i.e. a capacitor in parallel with the primary transformer winding 51. It is noted that this load capacitor forms a resonant circuit with the inductance seen at node A, which may be equal to the inductance of the primary transformer winding 51, although preferably there is a small inductor (not shown) arranged in series with the primary transformer winding 51 in order to increase the inductance seen at node A. Preferably, this inductor (providing leakage inductance) is incorporated in the transformer device such as to avoid the necessity of having an additional component connected in series with the transformer primary winding.

After a certain time delay (determined by the LC-time of said inductance seen at node A and said load capacitor), the voltage at node A reaches zero. It is advantageous if this time delay is not too short, because high values of dV/dt at node A result in radio noise being emitted. Then, or somewhat later, the second switch 112 is switched ON, the first switch 111 remaining OFF. Thus, the second switch 112 is switched ON while there is no voltage across this switch. Now, in a third stage with first switch 111 being OFF and second switch 112 being ON, a current is flowing through the second switch 112 and the primary transformer winding 51, node A being at the high voltage of line 107. This current flows in the opposite direction as compared with the first stage.

In a fourth stage, both switches 111 and 112 are OFF. The current continues to flow in the primary transformer winding 51, a current path being closed by the body diode of MOSFET 111 (or a separate diode arranged in parallel with the switch 111). As a result, the voltage at node A rises. It is noted that this can be seen as charging said load capacitor (not shown) in parallel with the second switch 112.

After a certain time delay (again determined by the LC-time of said inductance seen at node A and said load capacitor), the voltage at node A reaches the high voltage level of line 107. Then, or somewhat later, the first switch 111 is switched ON (while there is no voltage across this switch), and the above is repeated.

Switching a switch from non-conductive to conductive while the voltage across the switch is equal to zero will be indicated as "zero voltage switching".

In the above, the high-frequency switching of the bridge switches 111, 112 and 121, 122 (see FIG. 5) has been described independently of the switching of the current bursts 51 (see FIG. 4B). Especially at low duty cycles close to the threshold duty cycle $\Delta_T$, the number of bridge switching cycles in a burst 51 is quite low. This number can be equal to 10 (with $\Delta$=1%) or 5 (with $\Delta$=0.5%). Even small variations in the exact timing of the start of the bursts 51 with respect to the phase of the high-frequency bridge switching will cause variations in the starting conditions of the lamp and its resonant tank system, which may result in small variations of the average lamp current and hence in small but visible variations in the light output of the lamp (flickering).

In order to avoid this problem, the duty cycle switching of the bridge is preferably synchronized with the high-frequency switching of the bridge.

Such synchronization can be achieved if a low-frequency clock signal determining the duty cycle switching of the bridge and a high-frequency clock signal determining the high-frequency switching of the bridge are derived from the same source.

If the high-frequency clock signal determining the high-frequency switching of the bridge is free-running, such synchronization can be achieved if, in response to the low-frequency clock signal determining when the burst 51 is to be started, the actual start of the burst 51 is delayed until a predefined phase of the high-frequency clock signal, for instance a high/low transition or a low/high transition.

Another source of undesirable flickering may be presented by the power supply 106. It may be that this power supply 106 provides a true DC voltage, stable and free from ripple; in that case, the power supply does not give rise to flicker. However, if the power supply 106 derives its power from a mains source, after rectifying and buffering, it may in practice be unavoidable that the output of the power supply 106 shows a small ripple having twice the mains frequency. At the exact time of the start of a burst 51, the momentary value of the output voltage of the power supply 106 influences the time needed for the lamp to ignite: if this momentary value is somewhat higher, the lamp may ignite somewhat earlier and the lamp current is present somewhat longer, resulting all in all in a somewhat higher light output. These variations can be visible at low duty cycles, considering that, at a duty cycle of 0.5%, a small ignition delay of 1 μs may correspond to as much as 2% of the burst length, i.e. 2% variation of the light output.

In order to avoid this problem, the duty cycle switching of the bridge is preferably synchronized with the mains frequency.

FIG. 9A schematically shows a perspective view of a compact gas discharge lamp, generally indicated by the reference numeral 901. The lamp 901 comprises a lamp base 902, and four tube segments 911, 912, 913, 914 arranged parallel to each other. In the figure, the axial direction of the tubes is directed vertically; this direction will also be indicated as the longitudinal direction. The tubes extend vertically upwards from an upper surface 903 of the lamp base 902. Each lamp segment has two ends, i.e. a proximal end close to the lamp base 902 and a distal end at a distance from the lamp base 902. A first lamp electrode filament 921 is located at the proximal end of the first lamp segment 911. The first and second lamp segments 911, 912 are interconnected by a first bridge segment 931 close to their distal ends. The second and third tube segments 912, 913 are interconnected by a second bridge segment 932 close to their proximal ends. The third and fourth tube segments 913 and 914 are interconnected by a third bridge segment 933 close to their distal ends. A second electrode filament 922 is arranged at the proximal end of the fourth tube segment 914. Each electrode filament is provided with two electrode terminals extending through the base 902 downwards, and each being coupled to a corresponding connector extending from the underside of the lamp base 902, which for the sake of simplicity is not shown in FIG. 9A. An example of such a lamp is a PL-C lamp, commercially available from Philips. Therefore, a further explanation of this lamp design is not needed here.

In cases of extremely low dimming, for instance when starting a wake-up light, a further problem could be that a situation may occur that light is only generated in a proximal portion of the first tube segment 911 and a proximal portion of the fourth tube segment 914, close to the respective electrodes 921 and 922. This is believed to be caused by the fact that the operating conditions are insufficient to cause a proper discharge, and a capacitive current is flowing via the glass envelope of the tube segments. Slowly, these light generating portions grow towards the distal ends of the first and fourth tube segments 911, 914, and then the second and third tube segments 912, 913 may start to generate light, but it is also possible that the second and third tube segments 912, 913 do not contribute to the light output at all. All in all, the lamp may show erratic and unstable behavior.

To eliminate or at least reduce this problem, the lamp 901 according to the present invention is provided with an external auxiliary electrode 950, placed externally of the tube segments 911, 912, 913, 914. The auxiliary electrode is electrically conductive, has an axial extent corresponding to the axial length of the tube segments, and acts as a capacitive coupling, coupling the four tube segments 911, 912, 913, 914 to each other, facilitating a gas discharge to be generated over the entire length of all tube segments. The capacitive coupling is optimal if the auxiliary electrode is in mechanical contact with all tube segments 911, 912, 913, 914.

The auxiliary electrode 950 may be electrically floating, i.e. not electrically connected to any member of the electronic driver. However, an improved effect is obtained if the auxiliary electrode 950 is connected to a reference voltage. Suitable sources for such a reference voltage are ground, or one of the lamp electrodes. In a preferred embodiment, the auxiliary electrode 950 is connected to a voltage midway between the lamp electrode potentials. Preferably, auxiliary electrode 950 is connected to a node between said two capacitors 133 and 134.

Several shapes are possible for the auxiliary electrode. In the embodiment of FIG. 9A, the auxiliary electrode 950 has the shape of a rectangular block with a recess for accommodating the second bridge segment 932. It may be dimensioned such that its two main surfaces are in contact with all tube segments. FIG. 9B is a schematic perspective view of a preferred embodiment of the auxiliary electrode, here indicated by reference numeral 960, formed as a planar plate 911, which is intended to be placed just like the plate-shaped embodiment of FIG. 9A, i.e. extending between the first and second tube segments 911, 912 on the one side and the third and fourth tube segments 913, 914 on the other side. The plate 960 has a recess 965 for accommodating the second bridge segment 932. The plate 961 has a thickness slightly smaller than the distance between the first and fourth tube segments 911, 914. For firm fixation of the auxiliary electrode 960 to the lamp, the plate 961 is provided with lips 962, 963, 964 extending from a front vertical edge 966 opposite the recess 965, which lips are bent back, all in the same direction, substantially according to a radius corresponding to the radius of a tube segment. The lips may all have the same size. In the embodiment shown, the electrode 960 has two smaller U-shaped lips 962 just fitting around a tube segment over about 180°, and two larger J-shaped lips 964 extending to an adjacent tube segment. The lowermost lip 963 of the electrode 960 has an end portion bent towards the plate 961 so that this lip 963 fits around the tube segment over more than 180°.

The auxiliary electrode 960 is placed with its lips around either the first or the fourth tube segment, i.e. a tube segment containing an electrode, the choice depending on the direction into which the lips are bent; in the embodiment shown, this would be the fourth tube segment 914. The lips firmly clamp the auxiliary electrode 960 to this tube segment 914, with the plate 961 being in mechanical contact with this tube segment 914 over substantially its entire height. The plate 961 is further in mechanical contact with the neighboring tube segment 913, held in place by the J-shaped lips 964, yet without hardly any transverse force.

Instead of being substantially flat, the auxiliary electrode may have an undulating cross-section, so that it touches the tube segments at a discrete number of points along their length. In alternative embodiments, the auxiliary electrode may have a substantially circular outer cross section, implemented as a solid rod or as a hollow rod, as illustrated, placed in the central space between the tube sections. It is also possible that the auxiliary electrode is implemented as a wire that is helically wound around the perimeter of the tube segments. It is also possible that the auxiliary electrode comprises four electrode wires, each helically wound around a corresponding tube segment. It is also possible that the auxiliary electrode is implemented as a cylindrical brush placed in the central space between the tube sections.

While the invention has been illustrated and described in detail in the drawings and foregoing description, it should be clear to a person skilled in the art that the illustration and description are to be considered illustrative or exemplary and not restrictive. The invention is not limited to the disclosed embodiments; rather, several variations and modifications are possible within the protective scope of the invention as defined in the appending claims.

For instance, it is possible that the supply of the driver comprises a rectifier for rectifying an AC mains power, and a preconditioner and converter stage arranged between the rectifier and the first and second DC power lines, for converting the rectified AC power to stabilized DC power.

Further, in the preferred embodiment as described and illustrated, the driver comprises a full bridge topology. It is however possible to implement the invention using other topologies, for instance a half bridge topology in combination with a supply 106 of which the output voltage can be varied, for instance using a fly back or buck converter.

Figure 8:
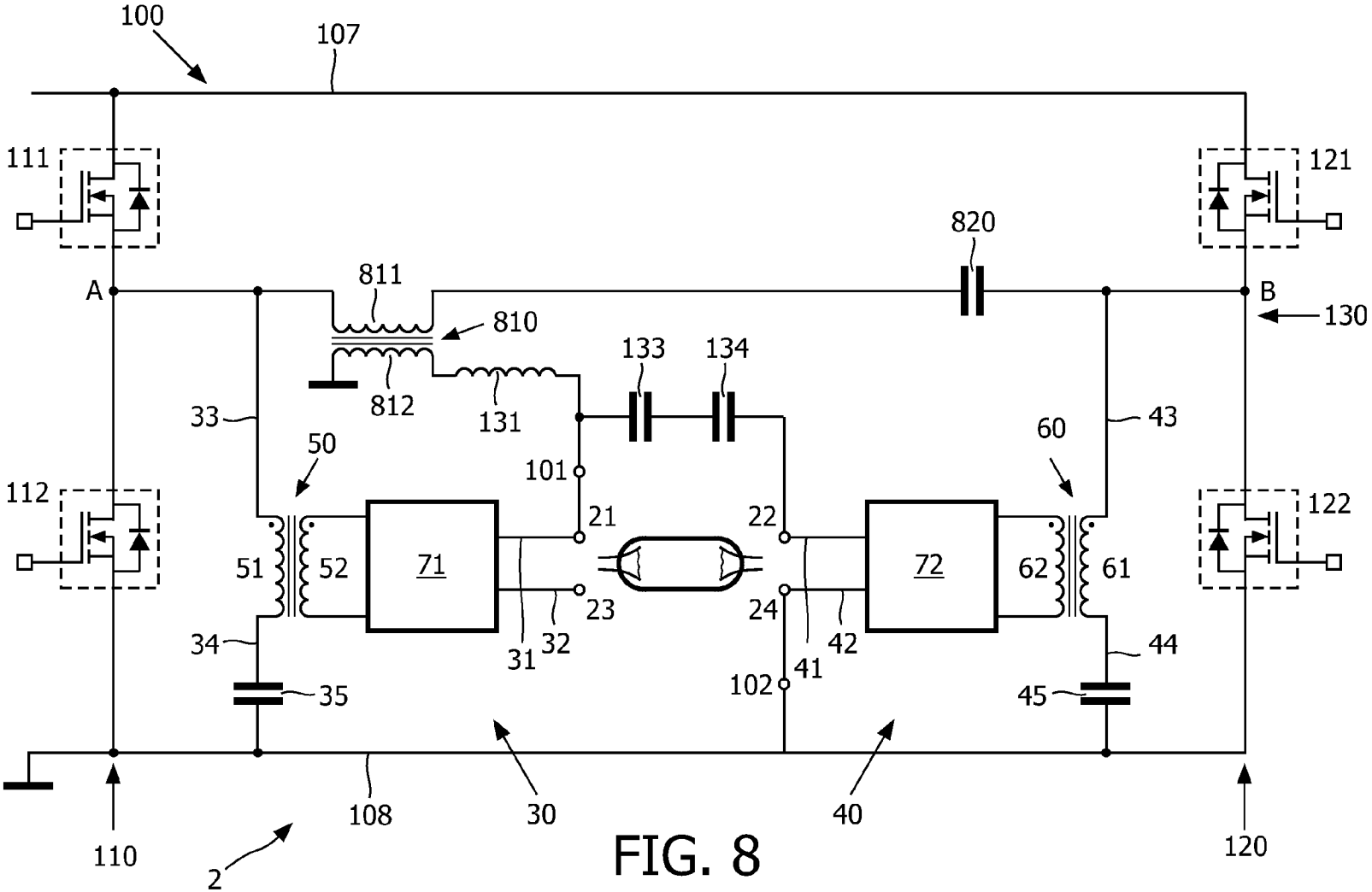
FIG. 8 is a block diagram schematically illustrating another preferred embodiment of an electronic driver with electrode heating means.

Further, in the preferred embodiment as described and illustrated, the lamp output terminals 101, 102 are connected in the bridge diagonal 130, so that each lamp electrode receives a voltage varying with respect to ground. For preventing radio disturbance, it may be desirable to keep one lamp electrode at a fixed voltage level, preferably ground. This can be achieved in the embodiment of FIG. 8, where the lamp output terminals 101, 102 are coupled to the bridge diagonal 130, through a coupling transformer 810. In the embodiment shown, the bridge diagonal 130 comprises a series arrangement of the primary winding 811 of the coupling transformer 810 and a DC decoupling capacitor 820. The secondary winding 812 of the coupling transformer 810 has one end connected to ground, and has another end connected to one main output terminal 101 through the resonant inductor 131. The other main output terminal is connected to ground.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

In the above, the present invention has been explained with reference to block diagrams, which illustrate functional blocks of the device according to the present invention. It is to be understood that one or more of these functional blocks may be implemented in hardware, where the function of such a functional block is performed by individual hardware components, but it is also possible that one or more of these functional blocks are implemented in software, so that the function of such a functional block is performed by one or more program lines of a computer program or a programmable device such as a microprocessor, microcontroller, digital signal processor, etc.

The invention claimed is:

1. A method of driving a gas discharge lamp to produce a variable light level in a range between a nominal light output level ($L_M$) and a minimum light output level, comprising the steps of:

generating an alternating lamp current (I) with a constant current amplitude;

when producing the nominal light output level ($L_M$), constantly supplying the lamp with the alternating lamp current (I) at a nominal current amplitude ($I_M$);

when producing light having a light output level in a first range below said nominal light output level ($L_M$), supplying the lamp with spaced apart current bursts having a burst duration Tc and a burst repetition period T where, in each current burst, the lamp is constantly supplied with the alternating lamp current (I) at the nominal current amplitude ($I_M$) and where, in the intervals between successive current bursts, substantially no current is supplied to the lamp, the light output level in the first range being varied by varying the burst duty cycle (Δ), defined as Δ=Tc/T, within a range between 100% and a minimum burst duty cycle value ($\Delta_T$);

when producing light having a light output level in a second range below said first range, supplying the lamp with spaced apart current bursts where, in each current burst, the lamp is constantly supplied with the alternating lamp current (I) at a reduced current amplitude ($I_R$) lower than the nominal current amplitude ($I_M$) and where, in the intervals between successive current bursts, substantially no current is supplied to the lamp, the light output level being varied by varying the reduced current amplitude ($I_R$) within a range between zero and the nominal current amplitude ($I_M$) while keeping the burst duty cycle (Δ) constant at said minimum burst duty cycle value ($\Delta_T$).

2. The method according to claim 1 where said minimum burst duty cycle value ($\Delta_T$) is in the range of 1% to 0.5%.

3. The method according to claim 1 where the light output level is gradually increased from zero to the nominal light output level by:

initially supplying the lamp with spaced apart current bursts having said predetermined minimum burst duty cycle value ($\Delta_T$) where, in each current burst, the lamp is constantly supplied with the alternating lamp current (I) having the reduced current amplitude ($I_R$) close to zero;

subsequently, while keeping the burst duty cycle (Δ) constant at said minimum burst duty cycle value ($\Delta_T$), gradually increasing the light output level by gradually increasing the reduced current amplitude until the current amplitude reaches the nominal current amplitude ($I_M$);

subsequently, while keeping the current amplitude constant at said nominal current amplitude ($I_M$), gradually increasing the light output level further by gradually increasing the burst duty cycle (Δ).

4. The method according to claim 1 where the burst repetition period is approximately 100 Hz.

5. The method according to claim 1 where the alternating lamp current has a constant frequency of about 100 kHz.

6. The method according to claim 1 where the alternating lamp current has a constant duty cycle equal to 50%.

7. A driver for driving a gas discharge lamp comprising a main power source for generating a lamp current (I) in spaced apart current bursts having a burst duration Tc and a burst repetition frequency 1/T where, in each current burst, the lamp current comprises an alternating current having a constant current frequency higher than the burst repetition frequency, a constant current amplitude, and a constant current duty cycle equal to 50%;

the driver, in a first mode, varying the burst duty cycle (Δ), defined as Δ=Tc/T, within a range between 100% and a minimum burst duty cycle value ($\Delta_T$) while keeping the current amplitude constant at a nominal current amplitude value ($I_M$);

and the driver, in a second mode, varying the current amplitude within a range between zero and the nominal current amplitude ($I_M$) while keeping the burst duty cycle (Δ) constant at said minimum burst duty cycle value ($\Delta_T$).

8. The driver according to claim 7, adapted to perform a method of driving a gas discharge lamp to produce a variable light level in a range between a nominal light output level ($L_M$) and a minimum light output level, comprising the steps of:

generating an alternating lamp current (I) with a constant current amplitude when producing the nominal light output level ($L_M$), constantly supplying the lamp with the alternating lamp current (I) at a nominal current amplitude ($I_M$);

when producing light having a light output level in a first range below said nominal light output level ($L_M$), supplying the lamp with spaced apart current bursts having a burst duration Tc and a burst repetition period T where, in each current burst, the lamp is constantly supplied with the alternating lamp current (I) at the nominal current amplitude ($I_M$) and where, in the intervals between successive current bursts, substantially no current is supplied to the lamp, the light output level in the first range being varied by varying the burst duty cycle (Δ), defined as Δ=Tc/T, within a range between 100% and a minimum burst duty cycle value ($\Delta_T$);

when producing light having a light output level in a second range below said first range, supplying the lamp with spaced apart current bursts where, in each current burst, the lamp is constantly supplied with the alternating lamp current (I) at a reduced current amplitude ($I_R$) lower than the nominal current amplitude ($I_M$) and where, in the intervals between successive current bursts, substantially no current is supplied to the lamp, light output level being varied by varying the reduced current amplitude ($I_R$) within a range between zero and the nominal current amplitude ($I_M$) while keeping the burst duty cycle (Δ) constant at said minimum burst duty cycle value ($\Delta_T$).

9. The driver according to claim 7 comprising electrode-heating power sources adapted to provide at least one of a constant filament heating current or a constant filament heating voltage, independent of the burst duty cycle (Δ) and independent of the current amplitude.

10. The driver according to claim 7 comprising:

a DC voltage source;

first and second DC power output lines connected to respective output terminals of the DC voltage source;

a first bridge leg including a first series arrangement of two controllable switches connected between said first and second DC power lines with a first bridge output node (A) between these two switches;

a second bridge leg including a second series arrangement of two controllable switches connected between said first and second DC power lines with a second bridge output node (B) between these two switches;

a bridge diagonal connected between said two output nodes (A, B); and a controller for controlling the switching operation of said switches.

11. The driver according to claim 10 where the controller is adapted to control the switches in such a way that each switch is continuously alternated between a conductive state and a non-conductive state at a switching frequency equal to the current frequency, where the two switches of the first bridge leg are always switched with a mutual phase difference of 180°, and where the two switches of the second bridge leg are always switched with a mutual phase difference of 180°; the controller being adapted to selectively set the phase difference (Δϕ) between the first bridge leg and the second bridge leg in a range between 0° and 180°.

12. The driver according to claim 11 where the controller is adapted, in the intervals between successive current bursts, to set said phase difference (Δϕ) to be equal to 0° in order to supply substantially no current to the lamp.

13. The driver according to claim 11 where the controller is adapted, during a current burst, to set said phase difference (Δϕ) to be equal to 180° in order to generate the alternating lamp current (I) having the nominal current amplitude ($I_M$).

14. The driver according to claim 11 where the controller is adapted, during a current burst, to set said phase difference (Δϕ) to have a value between 0° and 180° in order to generate the alternating lamp current (I) having the reduced current amplitude ($I_R$).

15. The driver according to claim 10 where the bridge diagonal comprises a series arrangement of lamp output terminals and inductive means with capacitive means arranged in parallel with said lamp output terminals.

16. The driver according to claim 10 comprising a coupling transformer where the bridge diagonal comprises a primary winding of the coupling transformer series with a DC decoupling capacitor and where the lamp has a first and second output terminals connected in series with a secondary winding of the coupling transformer.

17. The driver according to claim 10 for driving a hot cathode fluorescent lamp of a type comprising a lamp tube having an interior space and two electrode filaments arranged within the interior space, each electrode filament being provided with two electrode terminals extending to the exterior of the lamp tube;

the driver comprising at least one electrode-heating power source for providing electrode heating current to at least one of said lamp electrode filaments; and the at least one electrode-heating power source having as first input terminal coupled to a bridge output node for receiving input power from the main power source.

18. The driver according to claim 17 where the at least one electrode-heating power source comprises at least one transformer having a primary winding connected to the first input terminal and having a secondary winding coupled to a heating output terminal of said electrode-heating power source.

19. The driver according to claim 18 where said at least one electrode-heating power source comprises a capacitor connected between said primary transformer winding and a reference potential.

20. The driver according to claim 18 where said at least one electrode-heating power source comprises a voltage regulator coupled between said secondary winding and said heating output terminals.

21. A wake-up lighting device comprising a gas discharge lamp and a lamp driver comprising a power source for generating spaced apart current bursts of alternating lamp current (I), the device being adapted to operate in an off-mode in which no lamp current is generated and in a wake-up mode in which the power source:

initially generates an alternating a lamp current (I) with a minimum duty cycle value ($\Delta_T$) and a reduced current amplitude ($I_R$) close to zero;

subsequently gradually increases the current amplitude while keeping the duty cycle (Δ) constant at the minimum duty cycle value ($\Delta_T$) until the current amplitude reaches a nominal current amplitude ($I_M$);

subsequently gradually increases the duty cycle (Δ) while keeping the current amplitude constant at the nominal current amplitude ($I_M$).

22. The wake-up lighting device according to claim 21 where the gas discharge lamp comprises a plurality of tube segments arranged substantially parallel to each other, the tube segments having an axial length, the number of tube segments being an even integer, each tube segment having an interior space, and the tube segments being coupled to each other by transverse tube segments so that the interior space of one tube segment always communicates with the interior space of at least one other tube segment;

the device further comprising an electrically conductive external auxiliary electrode arranged outside the tube segments having an axial extent corresponding to the axial length of the tube segments, being capacitively coupled to all tube segments, and being coupled to a reference voltage level.

* * * * *